United States Patent [19]

Robinson et al.

[11] 4,411,831

[45] Oct. 25, 1983

[54] STABLE LIQUID ANIONIC DETERGENT COMPOSITIONS HAVING SOIL RELEASE PROPERTIES

[75] Inventors: Ronald A. Robinson; John O. Hudson, both of Garden Grove, Calif.

[73] Assignee: Purex Industries, Inc., Lakewood, Calif.

[21] Appl. No.: 326,439

[22] Filed: Dec. 2, 1981

[51] Int. Cl.[3] ..... C11D 1/83; C11D 3/20

[52] U.S. Cl. ..... 252/554; 252/174.23; 252/555; 252/557; 252/558; 252/559; 252/DIG. 2; 252/DIG. 14; 252/DIG. 15

[58] Field of Search ..... 252/8.6, 174.23, 554, 252/555, 558, 559, 557, DIG. 2, DIG. 14, DIG. 15

[56] References Cited

U.S. PATENT DOCUMENTS

| | | | |
|---|---|---|---|
| 3,712,873 | 1/1973 | Zenk . | |
| 3,893,929 | 7/1975 | Basadur | 252/8.6 |
| 3,959,230 | 5/1976 | Hays | 252/8.6 X |
| 3,962,152 | 6/1976 | Nicol et al. | 252/551 |
| 4,020,015 | 4/1977 | Bevan | 252/544 |
| 4,116,885 | 9/1978 | Derstadt et al. . | |
| 4,132,680 | 1/1979 | Nicol | 252/547 |

*Primary Examiner*—P. E. Willis, Jr.
*Attorney, Agent, or Firm*—Cushman, Darby & Cushman

[57] ABSTRACT

One may enhance the soil release properties of textile fabrics, particularly polyester containing fabrics, by laundering same with a stable aqueous detergent composition having enhanced soil release properties and consisting essentially of:

(a) 0.2 to 20.0% of an ethylene terephthalate/-polyethylene oxide terephthalate copolymer having a ETP/PEOTP ratio of 1:1 to 9:1 and a total molecular weight from about 9,000 to 60,000, the molecular weight of the polyethylene oxide terephthalate being from about 500 to about 6,000;

(b) 5 to 40% of an anionic detergent selected from the group consisting of linear benzene sulfonates having from 10 to 73 carbon atoms, alkane sulfonates having from 14 to 18 carbon atoms, alpha olefine sulfonates having from 14 to 18 carbon atoms, sulfosuccinates, and sulfonated alkyl diphenyloxides;

(c) up to 40% of a nonionic detergent selected from the group consisting of ethoxylated linear alcohols, ethoxylated alkylphenols, ethoxylated mono- and diglycerides and ethoxylated secondary alcohols; and (d) a buffer sufficient to maintain the pH of the aqueous composition within the range of 5.0 to 9.0.

7 Claims, No Drawings

STABLE LIQUID ANIONIC DETERGENT COMPOSITIONS HAVING SOIL RELEASE PROPERTIES

BACKGROUND OF THE INVENTION

The present invention is directed to stable aqueous detergent compositions which possess enhanced soil release properties.

The subject liquid detergent compositions contain carefully selected surface-active agents, hydrotropes, pH buffers and a soil-release copolymer. These ingredients are combined in to yield liquid detergent formulations that have excellent aesthetic as well as performance stability.

There is considerable reference in the literature to fomulations containing soil-release copolymers. The subject invention relates to only one type. This is a copolymer of ethylene terephtalate and polyethylene oxide terephthalate (EPT/PEOTP). More specifically it is a ETP/PEOTP copolymer with a rating of 1:1 to 9:1 and a molecular weight of about 500 to about 6,000 for the PEOTP and a total molecular weight of about 9,000 to 60,000. Examples of commercial products of this type are Zelcon 4780 (Dupont) and Milease T (ICI Americas). They are designed to give maximum soil-release when applied to 100% polyester fabric however, they also give some release properties to nylon, acetate and other synthetics.

The patent literature speaks to the difficulty of achieving performance (soil release) when the subject copolymers are incorporated into detergent formulations.

In U.S. Pat. No. 3,712,873 it is taught that copolymer release-agents such as used in this invention require special quaternary ammonium compounds plus special fatty alcohol ethoxylates ($C_{16-22}$+15-60 moles EO) to achieve performance. The present formulation are not compatible with the materials described and the alcohol ethoxylates described are not in the range one would select for good laundry detergency.

In U.S. Pat. No. 3,962,152 it is taught that performance is achieved by using a special copolymer considerably different in ETP/PEOTP ratio than that employed in the subject invention. The application is to granular detergents. The present soil-release agent is different and the composition is a liquid formulation.

U.S. Pat. No. 4,116,885 teaches that when using copolymers of the type preferred in the present invention a special component must be present to achieve performance. That component is 5-95% of the group consisting of $C_{8-18}$ alcohol sulfate, $C_{5-13}$ alcohol ethoxy (1-30 moles) sulfate and $C_{14-20}$ alcohol ethoxy (4-30 moles) sulfate. Up to 10% of the total detergent used may be some other anionic detergent. Further it is taught that of the total anionic detergent level used 0-25% may be $C_{8-18}$ LAS and/or $C_{14-20}$ alcohol ethoxy (1-3 moles) sulfate.

The primary object of the present invention is therefor to provide a liquid detergent having soil-release properties and which is stable from separation and precipitation for extended periods of time.

It is a further object of the present invention to provide a method whereby soil release properties may be imparted to fabrics during normal laundering operations whereby upon subsequent soiling and laundering, soil is readily released.

These and other objects of the present invention will be apparent from the discussion which follows.

DETAILED DESCRIPTION OF THE INVENTION

The present invention provides for a stable aqueous detergent composition having enhanced soil-release properties and consisting essentially of (by weight):

(a) 0.2 to 20.0% of an ethylene terephthalate/-polyethylene oxide terephthalate copolymer having a ETP/PEOTP ratio of 1:1 to 9:1 and a total molecular weight from about 9,000 to 60,000, the molecular weight of the polyethylene oxide terephthalate being from about 500 to about 6000;

(b) 5 to 40% (preferably at least 15%) of an anionic detergent selected from the group consisting of linear benzene sulfonates having from 10 to 73 carbon atoms, alkane sulfonates having from 14 to 18 carbon atoms, alpha olefine sulfonates having from 14 to 18 carbon atoms, sulfosuccinates, and sulfonated alkyl diphenyloxide;

(c) Up to 40% of a nonionic detergent selected from the group consisting of ethoxylated linear alcohols, ethoxylated alkylphenols, ethoxylated mono- and diglycerides and ethoxylated secondary alcohols; and (d) A buffer sufficient to maintain the pH of the aqueous composition within the range of 5.0 to 9.0, and preferably 6.5 to 7.5.

The buffer is essential to not only provide physical stability, but prevent the precipitation of added brighteners, etc. due to pH changes. Suitable buffers include bicarbonates, orthophosphate borates and alkanolamine hydrochlorides.

When used in a laundering operation, the detergent composition is placed in water with the fabric under agitation in amount sufficient to remove the soil from the fabric. Generally, from about 0.01 to 3.0% of the liquid detergent in the fabric is sufficient.

Fabrics most suitably treated in accordance with this liquid detergent are composed of polyester, i.e. 100% polyester or blends thereof such as cotton/polyester.

The liquid detergents of the present invention do not require an alcohol sulfate or alcohol ethoxy sulfate for performance.

A preferred surfactant for liquid laundry detergents is nonionic. There are many types, but those most frequently used are primary alcohol ethoxylates, ethoxylated mono and diglycerides, alkylphenol ethoxylates and secondary alcohol ethoxylates. The literature reports these surfactants to be performance compatible with the subject soil-release compounds. When formulated into liquid detergents at levels of about 10% and above these nonionics cause the soil-release compound to precipitate. We have found that the addition of specific anionic detergents stabilizes the physical stability of the soil-release agent, adds to the general detergency of the formula and allows the desired soil-release performance in the wash.

Formulation of the liquid detergent does not require exotic ingredients or extra activators to achieve good performance and also produce an aesthetically acceptable product.

In the examples which are described below a variety of detergents and emulsifiers have been referred to by their trade name as opposed to their chemical class and formulation. However, there are readily available as set forth in McCutcheon's "Detergents and Emulsifiers" (both the North American and International Editions 1977) and McCutcheon's "Functional Material", 1977, each of which is incorporated herein by reference.

The following examples are offered to more fully illustrate and compare the present invention, but are not to be construed as limiting the scope thereof.

EXAMPLE 1

(Comparative)

| | % Wt. |
|---|---|
| Igepal CO-710 | 30 |
| Sodium xylenesulfonate (SXS) | 5 |
| Zelcon 4780 | 4 |
| Water | q.s. |

The composition resulted in a solution with heavy flock that slowly precipitates. The same is true if the following are substituted for Igepal CO-710: Igepal CO-630, Neodol 25-7, Neodol 25-9, Neodol 25-12, Neodol 45-11, Tergitol 15-5-9, Alfonic 1012-60 and Varonic LI-63.

EXAMPLE 2

(Comparative)

| | % Wt. |
|---|---|
| Igepal CO-710 | 10 |
| SXS | 5 |
| Zelcon 4780 | 4 |
| Water | q.s. |

This composition yielded a hazy solution that developed a slight precipitate after standing at room temperature for several days. The other nonionics described in "Example I" give similar results.

EXAMPLE 3

(Comparative)

| | A % Wt. | B % Wt. | C % Wt. |
|---|---|---|---|
| Igepal CO-710 | 10 | 22.5 | 20 |
| Dowfax 2A1 | — | 5 | — |
| $NaC_{12}LAS$ | 5 | — | 10 |
| SXS | 5 | 5 | 5 |
| Zelcon 4780 | 4 | 4 | 4 |
| Water | q.s. | q.s. | q.s. |

These solutions were clear to slighty hazy and give little or no precipitate upon extended storage at room temperature. However, they tend to generate an acid pH on storage which is detrimental to brighteners.

It has been found that one can make very stable formulas using only anionic detergent. In fact, the preferred soil-release agents-Zelcon 4780 (DuPont) and Milease T (ICI Americas) formulate very well with many common anionic surfactants.

EXAMPLE 4

(Comparative)

| | A % Wt. | B % Wt. | C % Wt. |
|---|---|---|---|
| $NaC_{12}LAS$ | 30 | | |
| Na alpha olefin ($C_{14-16}$) sulfonate | — | 30 | — |

-continued

| | A % Wt. | B % Wt. | C % Wt. |
|---|---|---|---|
| Dowfax 2A1 | — | — | 30 |
| SXS | 5 | 5 | 5 |
| Zelcon 4780 | 4 | 4 | 4 |
| Water | q.s. | q.s. | q.s. |

All gave very clear solutions and no ppt developed upon prolonged storage at room temperature, but as in Example 3, did generate an undesirable acid pH.

When formulating a nonionic/anionic system the proper ratio necessary to obtain physical stability will depend upon the total level of surfactant used and the nature of the nonionic and anionic.

EXAMPLE 5

(Comparative)

| | A % Wt. | B % Wt. | C % Wt. | D % Wt. | E % Wt. | F % Wt. |
|---|---|---|---|---|---|---|
| $NaC_{12}LAS$ | 30 | 20 | 15 | 10 | 5 | 0 |
| Igepal CO-710 | 0 | 10 | 15 | 20 | 25 | 30 |
| SXS | 5 | 5 | 5 | 5 | 5 | 5 |
| Zelcon 4780 | 4 | 4 | 4 | 4 | 4 | 4 |
| Water | q.s. | q.s. | q.s. | q.s. | q.s. | q.s. |
| Precipitate at RT storage | (−) | (−) | (−) | (+) | (+) | (+) |

If sulfonated alkyldiphenyloxide, sodium $C_{14-16}$ alpha olefin sulfonate were used the level required for stability would change.

When formulating one must protect against high pH or the development of a high pH upon storage. The soil-release agents used will hydrolyze in the alkaline range. This becomes ojectionable when the pH begins to exceed 8.5 and can be a real problem above 9.0. Slightly acid conditions (pH down to about 5) do not adversely effect the soil-release stability. A buffer is therefore required to achieve pH stability during storage. Often the buffer need be present in only very small amounts.

EXAMPLE 6

(Comparative)

| | A % Wt. | B % Wt. | C % Wt. | D % Wt. |
|---|---|---|---|---|
| $NaC_{12}LAS$ | 20 | 20 | 30 | 20 |
| Igepal CO-710 | 10 | 10 | — | 10 |
| SXS | 3 | 3 | 4 | 4 |
| Urea | 1 | 1 | — | — |
| $NaHCO_3$ | — | 0.5 | 0.5 | 0.5 |
| Zelcon 4780 | 4 | 4 | 4 | 4 |
| $H_2SO_4$ | — | to pH = 7 | to pH = 7 | to pH = 7.0 |
| Water | q.s. | q.s. | q.s. | q.s. |

Formulation B has excellent aesthetic and performance stability upon prolonged storage at temperature up to 140° F. Formulation A gives good initial results, but the pH slowly increases due to urea hydrolysis and at pH's over about 8.5 one observes reduction in the soil-release performance. The rate is a direct function of the storage temperature. Formulae C and D also have excellent stability (aesthetic and performance). Acceptable performance is retained for more than 2 months at 120° F.

Performance was measured using a multiple cycle soil accumulation test. The soil used closely resembles human skin oil mixed with airborne dust. For screening purposes, polyester double knit fabric were used because differences are more readily apparent with it. Six $3\frac{1}{4}'' \times 3\frac{1}{4}''$ test swatches were used for each sample, and they were washed once in a tergotometer before soiling. Standard wash conditions were used, i.e., 120° F., 150 ppm water hardness (2:1 ratio of Ca to Mg), 90 cpm agitation speed and 0.10% use concentration. Reflectance measurements were used to determine % whiteness retention (R washed/R initial)

One cycle was sufficient to see drastic differences in soil release performance between formulas containing 4% of the copolymer and other commercially available liquid detergents.

The invention having been thus described, it will be appreciated that various departures can be made therefrom yet within the scope of the claims which follow. Furthermore, the compositions and methods of the present invention may comprise, consist or consist essentially of the materials and steps recited above.

We claim:

1. A stable aqueous detergent composition having enhanced soil release properties and consisting essentially of:

(a) 0.2 to 20.0% of an ethylene terephthalate/-polyethylene oxide terephthalate copolymer having a ETP/PEOTP ratio of 1:1 to 9:1 and a total molecular weight from about 9,000 and 60,000, the molecular weight of the polyethylene oxide terephthalate being from about 500 to about 6,000;

(b) 5 to 40% of an anionic detergent selected from the group consisting of linear benzene sulfonates having from 10 to 73 carbon atoms, alkane sulfonates having from 14 to 18 carbon atoms, alpha olefine sulfonates having from 14 to 18 carbon atoms, sulfosuccinates, and sulfonated alkyl diphenyloxide;

(c) up to 40% of a nonionic detergent selected from the group consisting of ethoxylated linear alcohols, ethoxylated alkylphenols, ethoxylated mono- and diglycerides and ethoxylated secondary alcohols; and (d) a buffer sufficient to maintain the pH of the aqueous composition within the range of 5.0 to 9.0.

2. The composition of claim 1 wherein said buffer is selected from the group consisting of a bicarbonate, orthophosphate, borate and alkanolamine hydrochloride.

3. The composition of claim 2 wherein the pH of the aqueous composition is within the range of 6.5 to 7.5.

4. The composition of claim 2 wherein the anionic detergent is present in an excess of 15%.

5. A method of imparting enhanced soil release properties to textile fabrics in a laundry cycle which comprises agitating said soiled textile fabrics in an aqueous solution containing an amount effective to remove the soil from the fabric of the detergent composition defined in claims 1, 2, 3 or 4.

6. The method of claim 5 wherein said detergent composition is present in an amount ranging from about 0.01 to 3.0%.

7. The method of claim 6 wherein said fabric is composed of polyester or a blend thereof.

* * * * *